US006550307B1

(12) United States Patent
Zhang et al.

(10) Patent No.: US 6,550,307 B1
(45) Date of Patent: Apr. 22, 2003

(54) PROCESS FOR CLEANING EXHAUST GAS USING LAMBDA CONTROL

(75) Inventors: Hong Zhang; Gerd Roesel, both of Regensburg (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/455,397

(22) Filed: Dec. 6, 1999

(30) Foreign Application Priority Data

Dec. 7, 1998 (DE) ..... 198 56 367

(51) Int. Cl.[7] ..... F02D 41/14
(52) U.S. Cl. ..... 73/23.32; 73/118.1; 60/277
(58) Field of Search ..... 60/276, 277; 73/23.31, 73/23.32, 118.1, 119 A

(56) References Cited

U.S. PATENT DOCUMENTS

| | | | | |
|---|---|---|---|---|
| 4,953,351 A | | 9/1990 | Motz et al. | 60/285 |
| 5,598,702 A | | 2/1997 | Uchikawa | 60/274 |
| 6,145,302 A | * | 11/2000 | Zhang et al. | 60/277 |
| 6,155,043 A | * | 12/2000 | Zhang et al. | 60/284 |

FOREIGN PATENT DOCUMENTS

| | | |
|---|---|---|
| DE | 35 00 594 C2 | 7/1986 |
| DE | 3827978 A1 | 5/1989 |
| DE | 44 34 786 C2 | 4/1995 |
| DE | 43 41 390 A1 | 6/1995 |
| EP | 0 596 635 | 5/1994 |
| JP | 4-112939 | 9/1990 |
| WO | WO 96/2864 | 9/1996 |

* cited by examiner

*Primary Examiner*—Harshad Patel

(57) ABSTRACT

A process for cleaning exhaust gas flow from an internal combustion engine using a catalyst, a lambda probe is disposed in the exhaust gas flow upstream from the catalyst and is connected to a controller that actuates the lambda probe, the controller receives a raw signal output from the lambda probe and forms a measurement signal that is supplied to control the internal combustion engine. The process includes regulating operation of the internal combustion engine such that a predetermined value of the lambda probe corresponds to a certain level of the measurement signal. Trimming the certain level of the measurement signal by a set value determined with an additional measuring pickup located downstream of the catalyst is performed, the trimming corrects the certain level of the measurement signal that corresponds to the predetermined value of the lambda probe. Switching the controller to a test mode in predetermined states of operation by the internal combustion engine and determining an actual value of a measurement signal falsification developed in the controller is performed. Compensating the measurement signal inversely to the actual value of the measurement signal falsification takes place. Varying the set value inversely to the actual value of the measurement signal falsification is performed.

7 Claims, 2 Drawing Sheets

PROCESS FOR CLEANING EXHAUST GAS USING LAMBDA CONTROL

This application claims the benefit of priority to German Application No. 19856367.1, filed Dec. 7, 1998, which is herein incorporated by reference.

BACKGROUND OF THE INVENTION

The invention relates to a process for cleaning the exhaust gas of an internal combustion engine with lambda control and trim regulation, in which a lambda probe is used with a controller.

It is known to use a three-way catalyst in the exhaust gas tract of an internal combustion engine to clean the exhaust gas. It is also known to use provide a lambda probe whose output signal is dependent upon the residual oxygen content in the raw exhaust gas upstream from the catalyst. It is believed that the residual oxygen content in the raw exhaust gas depends upon the fuel/air mixture dispersed in the internal combustion engine. It is known that in case of excess fuel (rich mixture), the residual oxygen content in the raw exhaust gas is lower, and in case of excess air (lean mixture), the residual oxygen content in the raw exhaust gas is higher.

There are also known broad-band lambda probes that are capable of outputting signals corresponding to a lambda range (0.7 to 4) in a linear fashion.

When evaluating the operating characteristics of the internal combustion engines, it is known to correlate the output signal from the lambda probe to a lambda value. It is also known that it is advantageous to correlate the lambda value of an exhaust gas to the actual lambda value of the exhaust gas- for example, when a three-way catalyst shows optimum catalytic properties at lambda=1, an output signal corresponding to lambda=1 should correspond to a condition where the lambda of the exhaust gas is equal to 1.

It is believed that the static and dynamic properties of the lambda probe upstream from the three-way catalyst are varied by aging and poisoning. It is known that the output signal which corresponds to lambda=1 differs from the actual output signal which corresponds to lambda=1. In order compensate for this differing output signal, it is well known to dispose an additional lambda probe downstream from the three-way catalyst. The additional lambda probe is used to monitor catalytic conversion by the three-way catalyst, for example, and therefore permits control of the fuel/air mixture by correcting the signal level associated with lambda=1. The use of the additional lambda probe allows optimum catalytic conversion to be sustained. This process is referred to as "guiding" or "trimming correction." It is known to use a measuring pickup which detects a pollutant concentration with a known correlation with the lambda value of the exhaust gas, (e.g., the NOx concentration).

It is known to use a controller in conjunction with a broad-band lambda probe. The controller actuates the broad-band probe and determines a measurement signal from a raw signal. The controller and a circuit therein may be subject to large temperature variations. Additionally, it is known that in order to operate the internal combustion engine within a range of acceptable lambda values such that optimum catalytic conversion occurs (referred to as a "lambda window"), it is necessary to precisely determine the measurement signal from the raw signal. In order to compensate for any inaccuracies due to the large temperature variations, it is known to operate the controller in a test mode in order to re-calibrate the controller. The re-calibration of the controller is believed to compensate for errors caused by the temperature variations. It is known that a time required for re-calibration depends on the raw signal, which is dependent on a phase of operation of the internal combustion engine. For this reason, it is desirable to operate the controller in test mode during a phase of operation which allows re-calibration during a short time interval. It is believed that the time interval is sufficiently short ensuring an idling phase of the internal combustion engine- when lambda=1.

SUMMARY OF THE INVENTION

The present invention provides a process for cleaning the exhaust gas of an internal combustion engine with a catalyst showing three-way properties disposed in the exhaust gas, and a lambda probe arranged upstream from the catalyst. The lambda probe is connected with a controller which actuates the lambda probe in order to form a measurement signal from the raw signal present at the raw signal output of the lambda probe. The regulation of the operation of the internal combustion engine is performed such that the lambda value of the raw exhaust gas assumes predetermined values at the lambda probe, a certain signal level of the measurement signal being associated with lambda=1. In a trimming adjuster, the concentration of an exhaust gas component downstream of the catalyst showing three-way properties is measured by means of an additional measuring pickup and a set value dependent thereon is formed with which the signal level of the measurement signal associated with lambda=1 is corrected. In an offset determination, an actual value of an additive measurement signal falsification developing during the formation of a measurement signal in the controller is corrected by switching the controller to a test mode in predetermined states of operation of the internal combustion engine, by determining the actual value. The actual value of the measurement signal falsification is compensated in the formation of the measurement signal. After an offset determination of the actual value of the measurement signal falsification, the actual set value of the trimming adjustment is varied to an appropriate degree contrariwise to the variation of the actual value.

The present invention provides for improved cleaning of an exhaust gas in an internal combustion engine such that a lambda range which corresponds to optimum catalytic conversion can be accurately maintained.

The present invention sets out from the knowledge that the largely constant active trimming adjustment also compensates for errors due to temperature or component inaccuracies since the set value of the trimming adjuster is adapted over a relatively long period of time such that the signal of the lambda probe downstream from the catalyst shows a value corresponding to lambda=1. If now an offset determination for the controller of the lambda probe that is ahead of the catalyst is performed, the actual value of the measurement signal falsification is compensated in the formation of the measurement signal, so that the shift of the signal level of the lambda probe ahead of the catalyst, that is caused by the set value of the trimming adjustment, is no longer correct. Only with a gradual adaptation brought about by the adaptation of the set value of the trimming adjustment will this error disappear again, and the operation of the internal combustion engine again approaches the lambda value best for the catalyst action, from which it had departed due to the abrupt change in the actual value of the signal falsification after the offset determination. To prevent this, according to the invention, after the offset has been determined the set value of the trimming adjustment is varied contrariwise to the variation of the actual value of the falsification of the measurement signal. That is to say, depending on the actual value of the measurement signal falsification, the set value of the trimming adjustment is permanently offset by the corresponding amount, or the initial value of a trimming adjuster embodied as a proportional integral regulator is changed one time after each offset determination. This contrariwise correction of measurement signal falsification and set value of the trimming adjustment leads after the determination of the offset to the same dynamic lambda value as before the offset determination, since the trimming adjustment had previously corrected, with its set value and integral content, the error which developed due to the drifting of the measurement signal falsification. The trimming is much more frequently active than the offset determination, since the latter can be performed only under specific conditions of the operation of the internal combustion engine.

The invention thus has the advantage that the corrections of the trimming adjustment affecting emissions is preserved to the full extent even after an offset determination with any desired amount of compensation of the measurement signal falsification.

This has the advantage, furthermore, that now the set value of the trimming adjustment can be used without limitation for diagnosing the components of the exhaust gas cleaning system, since it especially permits obtaining information on the lambda probe situated ahead of the catalyst, because it is not influenced by component inaccuracies or temperature-related measurement signal falsification in the controller.

In a preferred embodiment, in the case of a lambda probe in which a current signal vanishing at lambda=1 is present which is converted by the controller to a voltage, the controller is switched to the test mode by being separated from the raw signal output of the lambda probe. Then no raw signal current flows into the controller. The voltage put out by the controller as the measurement signal represents the actual value of the measurement signal falsification. This test mode is activated either in lambda-1 phases, e.g., in idling operation, or sufficient time must be allowed for the said build-up.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENTS

Figure 1:
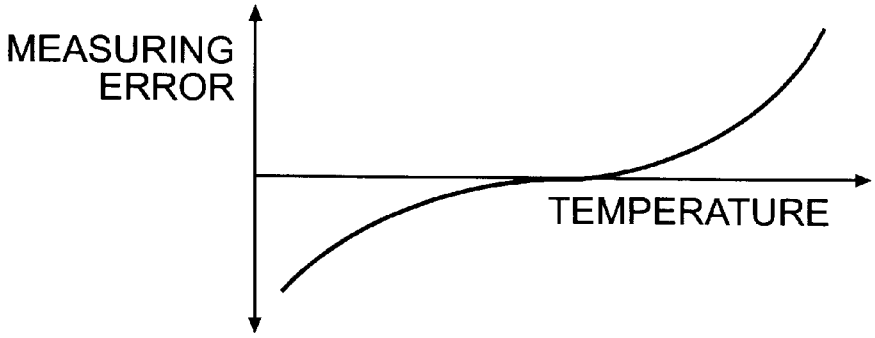
FIG. 1 shows a diagram with an example of a temperature-related measuring error caused by the controller.
Figure 2:
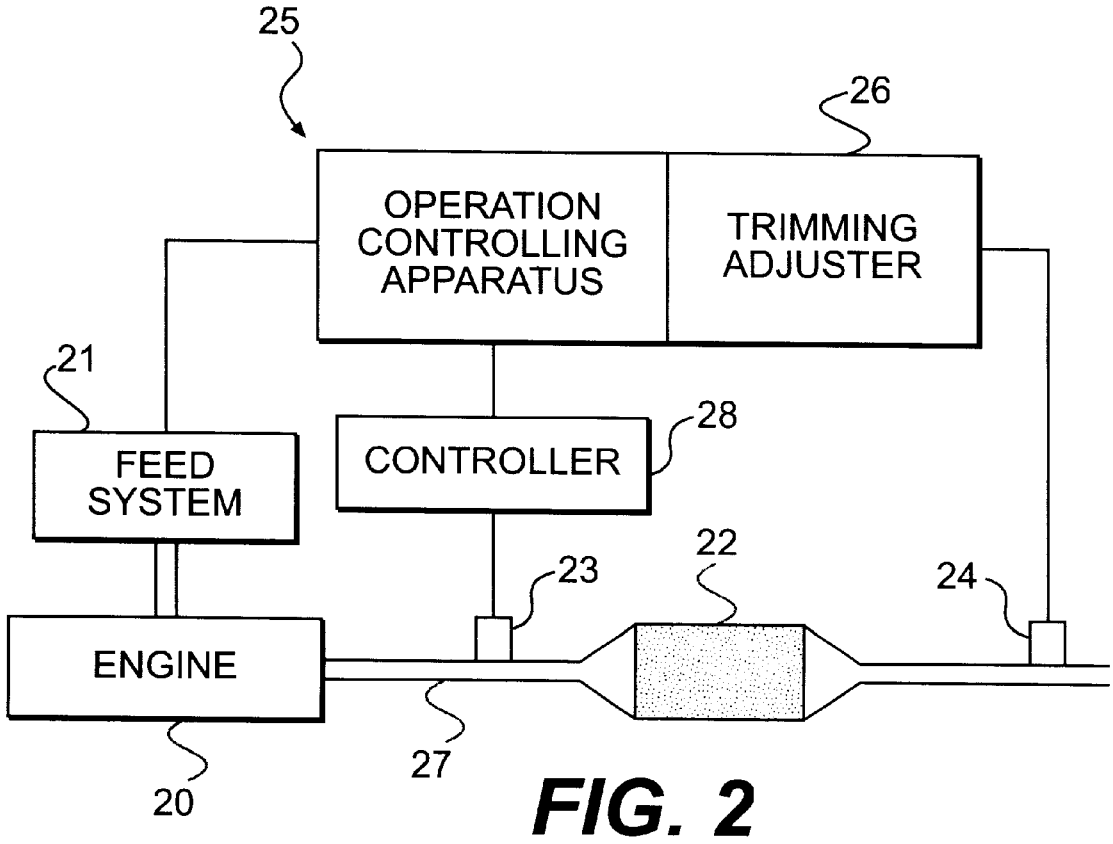
FIG. 2 shows a block diagram of an internal combustion engine with an exhaust gas cleaning system.

The invention relates to the cleaning of the exhaust gas of an internal combustion engine by means of an exhaust gas cleaning system as represented schematically in FIG. 2. A mixture-induction (carbureted) or fuel-injected internal combustion engine may be involved. The operation of the internal combustion engine 20 in FIG. 2 is controlled by an operation controlling apparatus 25. A fuel feed system 21, which can be in the form of a fuel injection system, for example, is controlled through lines, not shown, by the operation controlling apparatus 25, and provides for the distribution of fuel in the internal combustion engine 20. In the exhaust gas tract 27 is a catalyst 22. In this embodiment this is three-way catalyst, but other catalysts are possible, especially NOx storage catalysts. For the operation of the three-way catalyst a lambda probe 23 is provided upstream from it, which emits its raw signal, through lines not shown, to a controller 28, which then forms the measurement signal and feeds it to the operation control apparatus 25.

Downstream from the catalyst 22 is a post-catalyst lambda probe 24 whose measurement signal is carried over lines not shown to a trimming adjuster 26.

Furthermore, the measurements of other measuring pickups, especially relating to rotatory speed, load, catalyst temperature, which are not shown, etc., are also fed to the operation control apparatus 25. By means of these measurements the operation control apparatus 25 controls the operation of the internal combustion engine 20.

In addition to forming the measurement signal from the raw signal of the lambda probe 23, the controller 28 also operates the lambda probe 23, which is a broad-band lambda probe. The lambda=1 controlled operation of the internal combustion engine 20 is performed such that the measurement signal from the controller 28 indicating the oxygen content in the raw exhaust gas corresponds to a predetermined signal level. In a normal, fully operative lambda probe 23, this predetermined signal level corresponds to lambda=1 in the exhaust gas. The signal of the post-catalysis lambda probe 24 is used for the purpose of the fine adjustment of the signal level associated with lambda=1, as will be described below, and thus compensate variations of the lambda probe 23. For this purpose the value measured by the post-catalysis lambda probe 24 is used by means of the trimming adjuster 26, which can be an independent instrument or can be incorporated in the operation control apparatus 25, in order to compensate by means of a set value any shifting of the lambda=1 signal level of the lambda probe 23, due for example to aging, so that it is assured that the internal combustion engine 20 is regulated by the operation control apparatus 25 such that the lambda value of the raw exhaust gas in the exhaust gas tract 27 upstream from the catalyst 22 corresponds as accurately as possible to the desired catalyst window.

For working points outside of the catalyst window (lambda=1), the post-catalysis lambda probe 24 must issue a constant signal in order to be suitable for the trimming adjustment.

Figure 3:
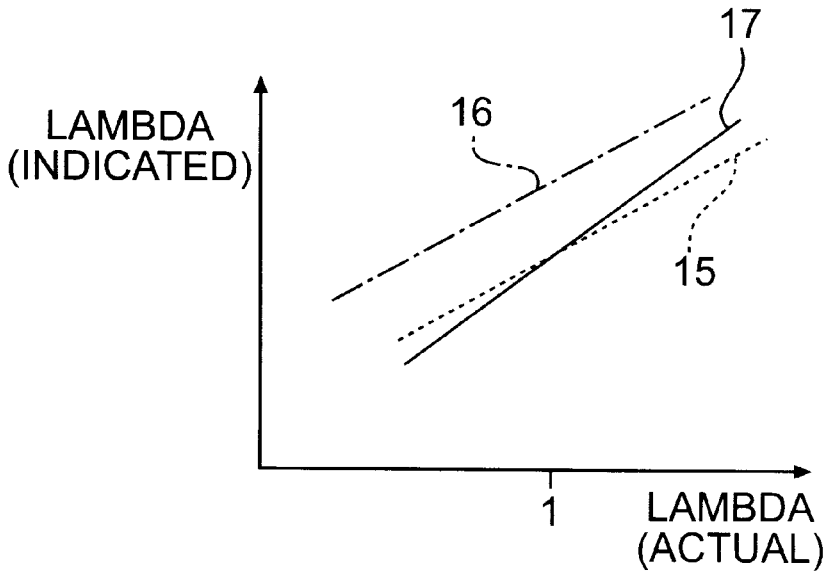
FIG. 3 shows a diagram which shows the lambda value indicated by a lambda probe as a function of the real lambda value.

In FIG. 3 the effect of the trimming control on the signal curve of the lambda probe 23 is represented. The curve 17 corresponds to the measurement signal of an ideal probe in which the indicated lambda value always corresponds to the actual lambda value. An aged lambda probe 23 shows, for example, the curve 16 in FIG. 3. The measurement signal indicates excessive lambda values and furthermore has a reduced sensitivity. With the set value of the trimming adjustment, the curve 16 can now be corrected such that the measurement signal of the aged lambda probe 23 corresponds to that of a probe with curve 15, which comes very close to the ideal curve 17 around lambda=1.

The controller 28, which forms the measurement signal from the raw signal from the lambda probe 23, includes a measurement signal falsification. This measurement signal falsification can be caused for one thing by the thermal response of components used in the circuit of the controller 28. For another thing, however, component inaccuracies may play a part in it. To offset this falsification, an offset determination is performed. For this, the controller 28 is switched to a test mode. Since the lambda probe 23 emits as a raw signal a current equal to 0 at lambda=1, the test mode is brought about as follows: The controller 28 is disconnected from the raw signal output from lambda probe 23 whenever the internal combustion engine is in a defined state of operation. This defined state of operation is, for example, idling. Other states are also possible, but it must be taken into consideration that the controller, due to certain time constants caused by resistance capacitance factors, lags behind any change in the raw signal. If the exhaust gas has a value close to lambda=1, the current of the raw signal is 0. This can be the case, for example, when the engine is idling. Switching to the test mode then causes no change in the current at the input of the controller, so there is no need to wait for any build-up, the switch-over time is minimal. For all other states of operation besides idling, an appropriate waiting period is necessary.

By comparing the measurement signal emitted by the controller 28 in the test mode with the measurement associated with lambda=1, e.g. a voltage on the order of 1.5 V, an actual value of the measurement signal falsification can be determined. This actual value of the measurement signal falsification is then compensated by the controller 28 in forming the measurement signal. Alternatively, allowance can be made for it also in the operation control apparatus 25.

Figure 4:
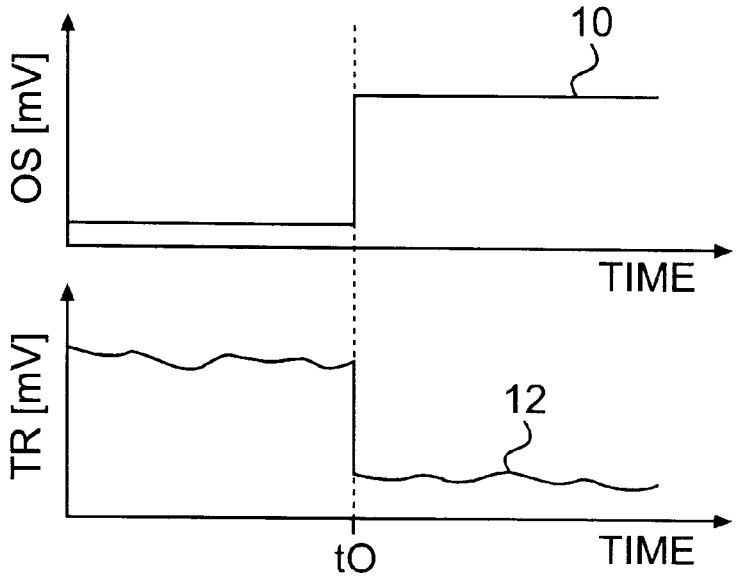
FIG. 4 shows a diagram of the timing of the set value of the trimming adjustment and of the actual value of the measurement signal error of the controller that is taken into account in the formation of the measurement signal.

This change in the actual output signal OS value of the measurement signal falsification is represented in curve 10 in FIG. 4. There it can be seen that, when the offset determination is performed at the time t0, the actual output signal OS value of the measurement signal falsification, which is used in forming the measurement signal from the raw signal, changes abruptly. It is significant that, depending on the operating profile of the internal combustion engine, a state of operation suitable for the offset determination is sometimes rare. The time span between two offset determinations can thus be quite great from case to case.

In this time span between two offset determinations, the actual measurement signal falsification remains not constantly equal to the actual output signal OS value used. The trimming adjustment also adapts its set value TR to the error created by the drifting measurement signal falsification, since the trimming adjustment is much more frequently active than the offset determination. During an offset determination, as it is represented in FIG. 4 at the time t0, in order to prevent the set value TR used by the trimming adjustment from becoming wrong, since now a modified actual value of the measurement signal falsification is used in forming the measurement signal from the raw signal, the set value TR of the trimming adjustment with the offset determination performed is corrected contrariwise to the variation of the actual output signal OS value. This contrariwise correction is represented in curve 12 in FIG. 4. The set value TR is varied at moment t0 contrariwise to the variation of the measurement signal falsification output signal OS. The degree of this change corresponds to the change in the actual output signal OS value of the measurement signal falsification, with respect to the lambda value. The contrariwise correction of the actual output signal OS value of the measurement signal falsification and of the set value TR of the trimming adjustment leads, after the offset determination, to the same dynamic lambda as before the offset determination. The trimming adjustment thus corrects substantially only errors of the lambda probe 23 itself and not errors of the controller 28 caused by temperature or by component inaccuracies, if the offset determination is performed frequently. This brings the result that the corrections of the trimming adjustment affecting emissions are maintained even after the offset determination, regardless of the size of changes in the actual output signal OS value of the measurement signal falsification.

When the internal combustion engine 20 is turned off, an offset determination and a contrariwise variation of the set value TR of the trimming adjustment are performed. Thereafter the set value TR of the trimming adjustment is stored for the next start-up of the internal combustion engine. Thus, while the internal combustion engine is running, adaptively determined set values TR of the trimming adjustment are corrected by the amount of the measurement signal falsification, even if, during the normal running of the internal combustion engine, there was no longer any operating phase suitable for offset determination. After the internal combustion engine 20 starts, an offset determination is made without intervention into the trimming adjustment, since the actual set value TR of the trimming adjustment by offset determinations made after the internal combustion engine stops is free of influence by errors of the controller.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What we claimed is:

1. A process for cleaning exhaust gas flow from an internal combustion engine using a catalyst, a lambda probe is disposed in the exhaust gas flow upstream from the catalyst and is connected to a controller that actuates the lambda probe, the controller receives a raw signal output from the lambda probe and forms a measurement signal that is supplied to control the internal combustion engine, the process comprising:

regulating operation of the internal combustion engine such that a predetermined value of the lambda probe from the raw signal output of the lambda probe corresponds to a certain level of the measurement signal;

trimming the certain level of the measurement signal by a set value determined with an additional measuring pickup located downstream of the catalyst, the trimming corrects the certain level of the measurement signal that corresponds to the predetermined value of the lambda probe;

switching the controller to a test mode in predetermined states of operation of the internal combustion engine and determining an actual value of a measurement signal falsification developed in the controller;

compensating the measurement signal inversely to the actual value of the measurement signal falsification; and varying the set value inversely to the actual value of the measurement signal falsification.

2. The process according to claim 1, wherein the switching to the test mode in a first one of the predetermined states of operation of the internal combustion engine occurs when the raw signal output from the lambda probe has a current equal to zero for the predetermined value of the lambda probe, and the actual value of a measurement signal falsification is determined by disconnecting the controller from the lambda probe.

3. The process according to claim 2, wherein the first one of the predetermined operating states of the internal combustion engine is an idling state of the internal combustion engine.

4. The process according to claim 3, wherein the predetermined value of the lambda probe is equal to one.

5. The process according to claim 2, wherein the switching to the test mode in second one of the predetermined states of operation of the internal combustion engine occurs when the predetermined value of the lambda probe is equal to one and there is a waiting period for the trimming to correct the certain level of the measurement signal that corresponds to the predetermined value of the lambda probe.

6. The process according to claim 1, further comprising:

turning off the internal combustion engine and again switching the controller for determining the actual value of the measurement signal falsification and again varying the set value inversely to the actual value; and storing the set value for use restarting the internal combustion engine.

7. The process according to claim 6, wherein the internal combustion engine is restarted without yet again varying the set value.

* * * * *